United States Patent [19]

Gaffney

[11] Patent Number: 4,898,222

[45] Date of Patent: Feb. 6, 1990

[54] GOLF CLUB HEAD COVER

[76] Inventor: John H. Gaffney, 4429 E. Osborn, Phoenix, Ariz. 85018

[21] Appl. No.: 296,136

[22] Filed: Jan. 12, 1989

[51] Int. Cl.[4] ..... A63B 57/00; B65D 65/02

[52] U.S. Cl. ..... 150/160; 206/315.4

[58] Field of Search ..... 150/52 G, 160; 206/315.4, 315.3

[56] References Cited

U.S. PATENT DOCUMENTS

| | | | |
|---|---|---|---|
| 2,035,529 | 3/1936 | Bucklin | 150/52 G |
| 2,822,848 | 2/1958 | Thoms | 150/52 |
| 3,072,167 | 1/1963 | Banas | 150/52 G |
| 3,426,815 | 2/1969 | Ashlin et al. | 150/52 G |
| 3,593,769 | 7/1971 | Spears | 150/52 G |
| 3,831,652 | 8/1974 | Hyden et al. | 150/52 G |
| 3,938,570 | 2/1976 | Stewart | 150/52 G |
| 4,119,129 | 10/1978 | Freiberg | 150/52 G |
| 4,368,768 | 1/1983 | Cunko, Jr. | 150/52 G |
| 4,667,716 | 5/1987 | Solheim et al. | 150/52 G |

*Primary Examiner*—Sue A. Weaver
*Attorney, Agent, or Firm*—LaValle D. Ptak

[57] ABSTRACT

A golf club head cover which is particularly suitable for use with irons and putters having a variety of different configurations, is in the form of a generally "L-shaped" boot. The "toe" portion of the cover encases the golf club head and the "leg" portion surrounds the shaft of the club adjacent the point where it is attached to the head. The cover is open on its rear side (the heel side of the club-head) to facilitate slipping it over the head withoiut any twisting or manipulation. After the cover is in place, the edges adjacent the shaft are pressed together to close mating strips of hook and loop fabric fasteners together to secure the cover around the shaft. The portion adjacent the rear of the head remains open to facilitate removal of the cover by pulling forwardly to utilize the leverage on the shaft to separate the hook and loop fastener strips.

14 Claims, 1 Drawing Sheet

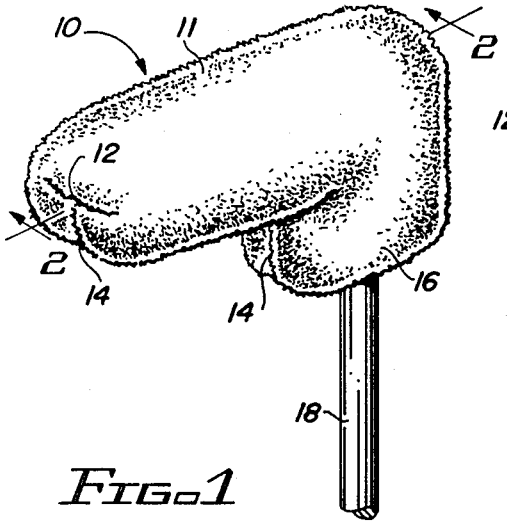
FIG. 1
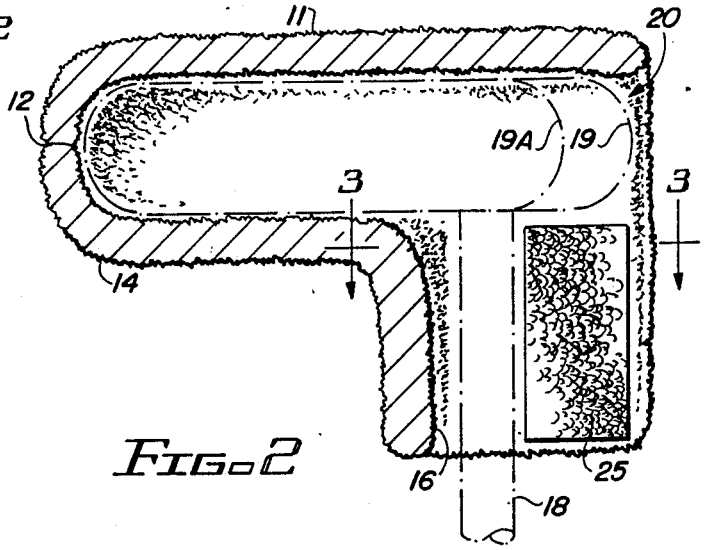
FIG. 2
FIG. 3
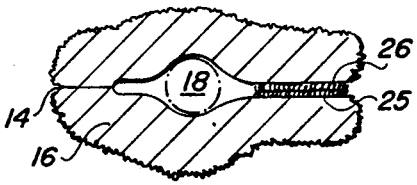
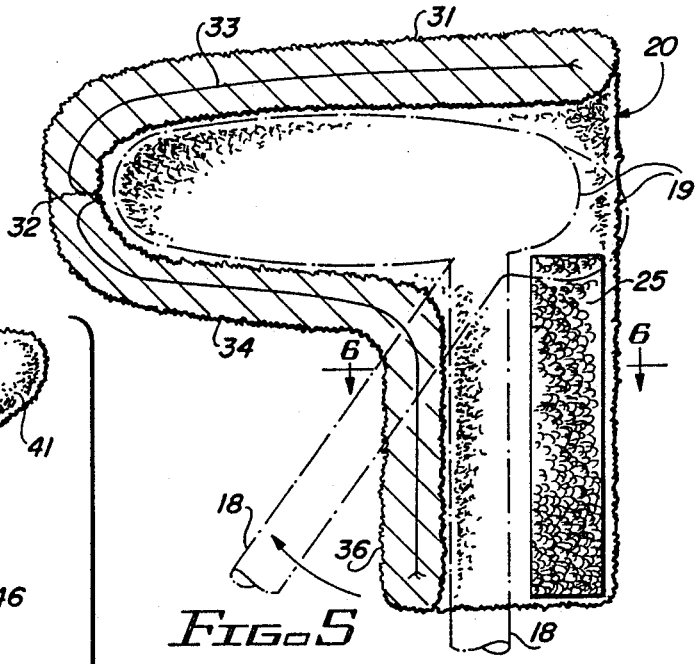
FIG. 5
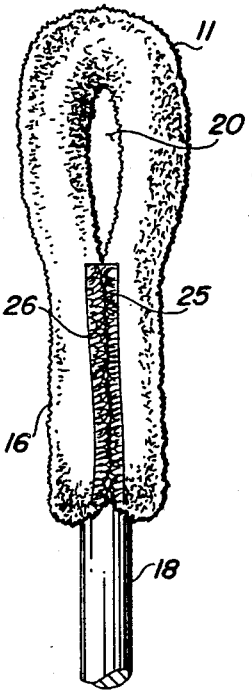
FIG. 4
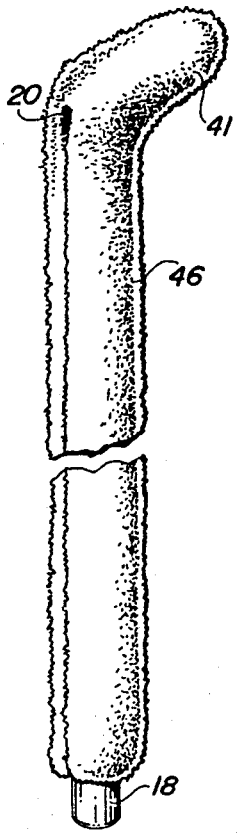
FIG. 7
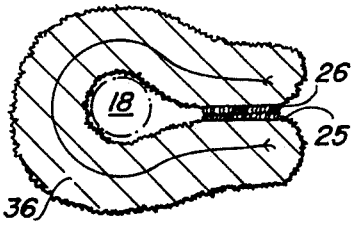
FIG. 6

GOLF CLUB HEAD COVER

BACKGROUND

Golfers typically carry a set of the various clubs required to play the game in a bag into which the club handles are inserted after inverting the club to cause the heads to extend out of the open end of the bag. When the bags are carried from place to place, the heads are repeatedly struck and battered. This also occurs when clubs are removed and inserted into the bag. "Sock" types of golf club covers have been constructed particularly for protecting the woods. These socks generally have an elastic neck on them to hold them in place over the wood when it is in the bag. They are readily and easily removed from the woods. In some cases, a draw string type of fastener is employed to secure the cover over the head and to prevent it from being accidentally dislodged.

It is much more difficult to provide a cover which is quickly installed and quickly removed from the heads of irons and putters. A protective cover for putters, in particular, is desirable since these are the shortest clubs in the bag and are repeatedly struck and battered. In addition, some golf putters have heads made of brass or other readily scratched or dented and scuffed material, so that protection is highly desirable.

Due to the shape of irons and putters, however, it has been difficult to provide a cover which could be quickly and conveniently held in place and readily removed. For example, irons have a front or toe portion which is relatively larger than the rear or heel portion, and are connected to the shaft at the heel portion end. Consequently, if an access opening is sized large enough to receive the toe portion of the club, the cover fits so loosely about the shaft of the club, that the cover frequently is inadvertently removed from the head of the iron or putter in which it is used.

The Banas U.S. Pat. No. 3,072,167 is directed to a golf club head cover particularly directed to a cover for putters. The cover disclosed in this patent is an elongated sleeve with an opening intermediate the ends. It is made with sufficient elasticity that it may be stretched longitudinally. To place the cover of the Banas Patent on a putter head, the toe of the head first is inserted through the opening. The device is stretched backward until the heel of the putter is inserted, and then the cover is released. The elastic material draws the cover toward the shaft from both ends to cause it to be held in place on the putter head. To remove the cover, the process is reversed. While this cover is relatively secure and is not readily dislodged, the procedure for placing it on a putter head and for removing it from the putter head requires some time and effort. In time, the elastic fails, and the cover must be replaced.

The Ashlin U.S. Pat. No. 3,426,815 is directed to a golf club cover designed particularly for "irons". This cover is fully enclosed on three sides to slip over the golf club head, with the toe of the head extending into the cover enclosure. The back or heel side has hook and loop mating fasteners on each side of it, and these fasteners are squeezed together over the heel of the club head to cause the cover to fit tightly over the head of the club. Nothing, however, extends over the shaft. As a consequence, the cover may be fairly easily dislodged.

The Spears U.S. Pat. No. 3,593,769 is directed to a cover which folds over the golf club head and then is attached to the shaft. The cover is open on the bottom or end facing the shaft of the club. It is fastened to the shaft by wrapping a portion around the shaft and snapping it into place. Similar covers have been marketed which have a hook and loop strap to wrap around the shaft and/or an extension of cover material to hold the cover in place.

Other putter covers have been marketed which are of a generally "L-shaped" or sock-like configuration which have a releasable opening on the front side (facing the toe of the club head). These covers are relatively easy to place over a club head; but even if a fabric hook and loop fastener is used, it is relatively difficult to open the fastener to remove the club, particularly if a putter having an extended heel is used. Another disadvantage of this type of cover, is that blade putters or irons frequently slide out or the cover gets knocked off when it hits the bag divider or bag edge.

"L-shaped" covers which use elastic around the leg portion to hold the cover over the shaft of the club also have a disadvantage of permitting blade putters and irons to slide out relatively easy. Heel putters and large mallet putters are difficult to insert into and remove from such covers, since they must be manipulated first in one direction and then the other to slide them into the covers and to remove them from the covers.

It is desirable to provide a protective cover for golf clubs, particularly for irons and putters of all types, which provides the desired protection, which stays in place, which is easy to put on and to remove, and which overcomes the disadvantages of the prior art.

SUMMARY OF THE INVENTION

Accordingly, it is an object of this invention to provide an improved golf club cover.

It is another object of this invention to provide an improved golf club head cover suitable for use with irons and putters.

It is an additional object of this invention to provide a golf club head cover which may be quickly, easily and detachably secured and removed from a golf club head.

A further object of this invention is to provide an improved golf club cover which is difficult to accidentally dislodge and which effectively may be used with irons and different types of putters.

In accordance with a preferred embodiment of this invention, a golf club cover has a first body portion made of flexible material and shaped to encase a golf club head. This first body portion is closed at the toe end and is open at the heel end. A second body portion is attached to the first body portion adjacent the heel end and at substantially right angles to the first portion. The second portion is shaped to encase at least the portion of the golf club shaft where it is attached to the head. The second portion is open on the end opposite the end at which it is attached to the first body portion and also is open along the side adjacent the opening in the heel end of the first portion to form a single composite opening in the cover. A releasable fastener, for closing the opening on the side of the second body portion, is provided to secure the second body portion around the shaft of a golf club, with the shaft extending through the open end of the second portion. A snug fit is provided; so that the cover protects the head and, additionally, the portion of the club shaft from the head to the extent of the length of the second body portion.

BRIEF DESCRIPTION OF THE DRAWING

FIG. 1 is a perspective view of a preferred embodiment of the invention illustrating its use;

FIG. 2 is a cross-sectional view of the embodiment of FIG. 1 taken along the line 2—2 of FIG. 1;

FIG. 3 is a cross-sectional view taken along the line 3—3 of FIG. 2;

FIG. 4 is an end view of the embodiment shown in FIG. 1;

FIG. 5 is a cross-sectional view, similar to FIG. 2, illustrating another embodiment of the invention;

FIG. 6 is a cross-sectional view taken along the line 6—6 of FIG. 5; and

FIG. 7 illustrates an alternative embodiment of the invention.

DETAILED DESCRIPTION

Reference now should be made to the drawings in which the same reference numbers are used throughout the different figures to designate the same components. FIG. 1 shows a putter and iron cover 10 in accordance with a preferred embodiment of the invention. This putter cover preferably is made of a single sheet of padded material cut in a blank in a generally "T" shaped configuration. The material then is folded over on itself to form a generally "L-shaped" cover and it is sewn together along the edge at the seam 14. Depending upon the particular configuration desired, the material also may be cut to form a widened end formed by a short transverse seam 12, as illustrated in FIG. 1.

The resultant cover has a main body portion 11 which has an internal cavity large enough to fit over the heads of putters and irons of different sizes. This cavity has a second shaft encircling portion 16 integrally attached to it. As is most apparent from FIG. 2, the portion 16 extends generally parallel to the shaft 18 of a golf club inserted into the cover. Also, as shown most clearly in FIG. 2, the overall configuration of the device is an "L-shaped" or boot-shaped cover.

As shown in FIG. 2, the shaft 18 of the golf club is attached to a putter or iron head 19 which may be of any of a variety of different configurations. The putter 19 is shown with an extended heel on it. The dotted line 19A is used to illustrate the alternate configuration of a blade putter or iron. The entire heel side of the portion 11, as well as the rear side of the portion 16, which is attached to the heel of the portion 11, is open, as shown at 20 in FIG. 2.

The bottom cross-sectional view of FIG. 3 illustrates the manner in which the portion 16 is formed, and also shows the configuration when the device is closed over the shaft 18 of the golf club to secure the cover in place. Closure is provided by means of mating strips of fastening material sewn onto opposite sides of the opening 20 in the portion 16. These strips comprise mating hook and loop (male and female) fasteners, with the hook portion 25 on one side, and the loop portion 26 on the other side, as illustrated in FIG. 3. The strips 25 and 26 extend from the open edge 20 in the portion 16 to a point near the opposite edge at the seem 14 and are spaced from the seem 14 a distance equal to or slightly greater than the diameter of the shaft 18. Typical material which may be used for this purpose is popularly sold under the trademark VELCRO®.

As is apparent from an examination of both FIGS. 2 and 3, the fastener material strips 25 and 26 extend throughout the length of the portion 16 of the cover, but do not extend into the heel area 20 of the portion 11 where the club head is located. This area is left open, as shown most clearly in FIG. 4, which is a rear view of the embodiment shown in FIGS. 1 and 2. Thus, when the cover 10 is in place on a golf club, the hook and loop fabric fastener strips 25 and 26 are pinched together to secure the cover tightly around the shaft 18 of the golf club. The heel area 20 of the portion 11 is open, but the dimension of the internal cavity of the portion 11 are selected to cause the heel of the club head 19 to be completely surrounded by the cover. The heel of the club may be observed through the opening 20, but it does not extend outwardly through the opening 20.

FIG. 5 illustrates a variation of the cover shown in FIGS. 1 through 4. In the cover of FIG. 5, the material which forms the cover may be a relatively thick or padded material which is doubled over prior to stitching it together in the configuration shown in FIG. 1. This results in an inner seam 33, and the two portions of the cover 31 and 36 correspond to the portions 11 and 16 of the embodiment of FIG. 1. Similarly, seams 32 and 34 correspond to the seams 12 and 14 of FIG. 1, and otherwise the structure of the cover of FIG. 5 is the same as the one described in conjunction with FIGS. 1 through 4.

As illustrated in FIG. 5, the portion 36 is longer relative to the portion 31 than the portion 16 is to the portion 11 of the embodiment of FIGS. 1 through 4. This is particularly helpful when the cover is to be used in conjunction with blade putters or irons. In addition, the longer portion 36 is particularly desirable when the golf club shaft is made of graphite, since graphite shafts are relatively easily nicked and damaged.

In both embodiments of the invention, the cover is easily removed by pulling the cover at the opening 20 toward the toe of the club head or toward the left (as viewed in FIGS. 2 and 5) to utilize the leverage of the shaft 18 at the place it is attached to the head 19 to separate the hook and loop VELCRO® fasteners 25 and 26 to strip the cover from the head. This results in a very quick and efficient cover removal by the golfer whenever it is desired to use the club on which the cover has been placed. The cover remains open after removal. When play with that particular club is completed, the club easily is inserted through the wide-open heel or rear side of the cover simply sliding the cover onto the club head from left to right (as viewed in FIGS. 2 and 5). Once the cover is in place, the fastener strips 25 and 26 are pinched together along the shaft 18. The cover once again is securely held in place.

The length of the portion 16 or 36 typically is two inches (2") or more. For blade putters and irons, a length of approximately three inches (3") has been found sufficient to prevent accidental removal of the cover from the golf club head. Sufficient length of the portion 16 or 36 must be provided to prevent counterclockwise twisting of the cover (as viewed in FIGS. 2 and 5) from accidentally taking place as clubs are inserted into and removed from the golf bag.

FIG. 7 illustrates a variation of the embodiments of FIG. 5 or FIGS. 1 through 4 which may be utilized to protect graphite shafts. The portion 16 has been replaced with an elongated portion 46 which simply comprises an elongated extension of the covers shown in FIGS. 2 and 5. The length of the portion 46 is selected to cover the major portion or all of the shaft to be protected. The main body portion 41 of the embodiment shown in FIG. 7 is identical to the portions 11 or 31 of the embodiments of FIGS. 1 or 5. In all other respects, the cover of FIG. 7 is placed onto and removed from the golf club head in the same manner as the covers described in the other embodiments. Continuous hook and loop fasteners may be provided along the entire length of the portion 46, or such fasteners may be provided at selected intervals as desired. The opening 20, however, adjacent the heel of the head of the club is not fastened in the embodiment of FIG. 7, so that this area remains open in the same manner as illustrated in FIG. 4.

The foregoing description of the preferred embodiments of the invention is to be considered illustrative of the invention and not as limiting. Various changes and modifications will occur to those skilled in the art without departing from the true scope of the invention. Fasteners other than hook and loop fabric fasteners may be used, if desired, to accomplish the same purpose. Multilayer material or padding may be employed. The relative dimensions which have been described may be varied for particular applications also without departing from the true scope of the invention as defined in the appended claims.

I claim:

1. A head cover for golf club irons or putters where the head is attached to the end of a shaft, said cover including in combination:

a first body portion made of flexible material and shaped to encase a golf club head having a toe and a heel, said first portion having a toe end and a heel end and being open on the heel end thereof;

a second body portion having first and second ends, with the first end thereof attached to said first body portion at the heel end thereof and at substantially right angles thereto for encasing at least a portion of the shaft of said golf club where it is attached to the head, said second portion being open on the second end and open on the side thereof adjacent the opening in said first portion to form a single continuous opening therewith in said cover; and closing means comprising facing male and female fastener means located on on opposite sides of the inside of said second body portion adjacent the opening on the side thereof, for releasably closing the opening on the side of said second body portion to secure it around the shaft of a club, leaving the heel end of said first portion open when the head of such club is inserted into said first body portion, said shaft extending through the opening in the second end of said second body portion.

2. The combination according to claim 1 wherein the interior of said cover comprises an elongated, generally "L-shaped" pocket enclosure extending from said first body portion, for enclosing the head of a golf club, to the interior of said second body portion for surrounding and enclosing the shaft of a golf club a predetermined distance from the point at which it is attached to the head.

3. The combination according to claim 2 wherein said flexible material includes padding having a thickness selected to cushion a golf club head against blows thereto.

4. The combination according to claim 3 wherein said first and second body portions are formed from a single piece of flexible material and are interconnected to form an "L-shaped" cover, with said continuous opening in said first body portion and in the side of said second body portion extending parallel to the shaft of a golf club inserted therein.

5. The combination according to claim 4 wherein said closing means comprises first and second strips of fastening material attached, respectively, on each side of said opening on the side of said second body portion, with said first strip comprising a plurality of hooks projecting therefrom and said second strip comprising a plurality of loops adapted to co-act with said hooks to releasably close the opening on the side of said second body portion when said strips of fastening material are pressed together.

6. The combination according to claim 5 wherein the width of said second body portion in a plane perpendicular to the plane of the shaft of a golf club inserted therein is greater than the diameter of a golf club shaft, and said strips of fastening material extend substantially from the open edge of said second body portion to a point near the opposite side thereof and are spaced from such opposite side a distance at least equal to the diameter of a golf club shaft.

7. The combination according to claim 6 wherein the length of said first body portion from the toe end to the heel end thereof is at least equal to the length of the head of the club to be inserted therein, with the closed edge of said second body portion located sufficiently close to the toe end of said first body portion to permit the head of a golf club inserted into said head cover to be fully encased within said first body portion.

8. The combination according to claim 1 wherein said second body portion is elongated to surround a substantial portion of the shaft of a golf club, with said closing means extending along the length of the opening on the side thereof which parallels the axis of such a golf club shaft.

9. The combination according to claim 1 wherein said first and second body portions are formed from a single piece of flexible material and are interconnected to form an "L-shaped" cover, with said continuous opening in said first body portion and in the side of said second body portion extending parallel to the shaft of a golf club inserted therein.

10. The combination according to claim 1 wherein said flexible material includes padding having a thickness selected to cushion a golf club head against blows thereto.

11. The combination according to claim 1 wherein the length of said first body portion from the toe end to the heel end thereof is at least equal to the length of the head of the club to be inserted therein, with the closed edge of said second body portion located sufficiently close to the toe end of said first body portion to permit the head of a golf club inserted into said head cover to be fully encased within said first body portion.

12. The combination according to claim 11 wherein said second body portion is elongated to surround a substantial portion of the shaft of a golf club, with said closing means extending along the length of the opening on the side thereof which parallels the axis of such a golf club shaft.

13. The combination according to claim 1 wherein the interior of said cover comprises an elongated, generally "L-shaped" pocket enclosure extending from said first body portion, for enclosing the head of a golf club, to the interior of said second body portion for surrounding and enclosing the shaft of a golf club a predetermined distance from the point at which it is attached to the head.

14. A head cover for golf club irons or putters where the head is attached to the end of a shaft, said cover including in combination:

a first body portion made of flexible material and shaped to encase a golf club head having a toe and a heel, said first portion having a toe end and a heel end and being open on the heel end thereof;

a second body portion having first and second ends, with the first end thereof attached to said first body portion at the heel end thereof and at substantially right angles thereto, the width of said second body portion in a plane perpendicular to the plane of the shaft of a golf club inserted therein being greater than the diameter of a golf club shaft, said second body portion encasing at least a portion of the shaft of said golf club where it is attached to the head, said second portion being open on the second end and open on the side thereof adjacent the opening in said first portion to form a single continuous opening therewith in said cover; and closing means comprising first and second strips of fastening material attached, respectively, on each side of said opening on the side of said second body portion, said strips of fastening material extending substantially from the open edge of said second body portion to a point near the opposite side thereof and spaced from such opposite side a distance at least equal to the diameter of a golf club shaft, with said first strip comprising a plurality of hooks projecting therefrom and said second strip comprising a plurality of loops adapted to co-act with said hooks to releasably close the opening on the side of said second body portion when said strips of fastening material are pressed together for releasably closing the opening on the side of said second body portion to secure it around the shaft of a club when the head of such club is inserted into said first body portion, said shaft extending through the opening in the second end of said second body portion.

* * * * *